US010414465B1

(12) United States Patent
Zhou

(10) Patent No.: US 10,414,465 B1
(45) Date of Patent: Sep. 17, 2019

(54) HYDRAULIC BOW DOOR APPARATUS

(71) Applicant: WUXI XINFAN MARINE EQUIPMENT CO., LTD., Wuxi, Jiangsu (CN)

(72) Inventor: Xiaohua Zhou, Jiangsu (CN)

(73) Assignee: WUXI XINFAN MARINE EQUIPMENT CO., LTD., Wuxi (CN)

( * ) Notice: Subject to any disclaimer, the term of this patent is extended or adjusted under 35 U.S.C. 154(b) by 0 days.

(21) Appl. No.: 16/053,817

(22) Filed: Aug. 3, 2018

(51) Int. Cl.
*B63B 27/14* (2006.01)
*B63B 3/46* (2006.01)
*B63B 19/08* (2006.01)

(52) U.S. Cl.
CPC ..... *B63B 3/46* (2013.01); *B63B 19/08* (2013.01); *B63B 27/143* (2013.01); *B63B 2019/083* (2013.01)

(58) Field of Classification Search
CPC ... B63B 27/14; B63B 2027/141; B63B 17/04; B63B 2019/086; B63B 2019/083
See application file for complete search history.

(56) References Cited

U.S. PATENT DOCUMENTS 4,161,795 A * 7/1979 Quest ..... B63B 27/14 114/362

FOREIGN PATENT DOCUMENTS

CN 103112582 A 5/2013
CN 104816789 A 8/2015

* cited by examiner

*Primary Examiner* — Andrew Polay

(57) ABSTRACT

A hydraulic bow door apparatus, comprising a bow door movably mounted on a deck by a hinge shaft, the bow door comprises a doorframe and a door leaf hermetically mounted together, the front side of the doorframe is mounted with a hydraulic actuating cylinder, the cylinder body of the hydraulic actuating cylinder is hinged with the doorframe, the end of its piston rod is hinged with the hinge shaft through a first connecting rod assembly, after the piston rod of the hydraulic actuating cylinder is pushed out, the bow door is turned into a horizontal placement state; and the front side of the bow door is mounted with a foldable guardrail assembly. The hydraulic bow door apparatus ensures the protective security of a passage which is formed after the bow door is connected to dock.

7 Claims, 2 Drawing Sheets

HYDRAULIC BOW DOOR APPARATUS

TECHNICAL FIELD

The invention relates to the field of marine technology, and in particular to a bow door apparatus.

BACKGROUND

A bow door is the door located at the front-end of a ship. When the bow door is opened, a bow board can be connected to dock to facilitate passage of vehicles up and down. However, the currently used bow door only plays the role of connecting the ship with the dock after being opened, the function is single, and the existing hydraulic bow door has a large stroke of the hydraulic cylinder and poor opening stability.

SUMMARY OF THE INVENTION

In view of above problems of the existing bow door, the applicant provides a hydraulic bow door apparatus based on research and improvement. The present invention employs the following scheme:

A hydraulic bow door apparatus comprises a bow door movably mounted on a deck by a hinge shaft, wherein, the bow door comprises a doorframe and a door leaf hermetically mounted together, the front side of the doorframe is mounted with a hydraulic actuating cylinder, the cylinder body of the hydraulic actuating cylinder is hinged with the doorframe, the end of its piston rod is hinged with the hinge shaft through a first connecting rod assembly, after the piston rod of the hydraulic actuating cylinder is pushed out, the bow door is turned into a horizontal placement state; and the front side of the bow door is mounted with a foldable guardrail assembly.

As further improvement of the technical scheme described above:

The guardrail assembly comprises an upper guardrail and a lower guardrail which are set up and down after being unfolded, the upper guardrail and the lower guardrail are hinged with the doorframe through a second connecting rod assembly; the upper guardrail is hinged with the doorframe through a first connecting rod and a second connecting rod which are crosswise hinged, the hinged point between the first connecting rod and the second connecting rod is hinged with the lower guardrail, a third connecting rod is connected between the lower guardrail and the doorframe, and a fourth connecting rod and a fifth connecting rod are respectively connected between the lower guardrail and the first connecting rod and the second connecting rod.

The upper guardrail and the lower guardrail are U-shaped, with both sides connected with the doorframe through the second connecting rod assembly.

Both sides of the doorframe are symmetrically provided with a first hinge seat and a first sliding seat, the hinge seat and the first sliding seat are located on both ends of the doorframe, and the first sliding seat is provided with a sliding slot of the sliding seat; the upper guardrail is provided with an upper sliding slot, the lower guardrail is provided with a lower sliding slot; the first hinge seat is hinged with a lower end of the first connecting rod, and an upper end of the first connecting rod is hinged in the upper sliding slot and can slide along the upper sliding slot, and a lower end of the second connecting rod is hinged in the sliding slot of the sliding seat and can slide along the sliding slot of the sliding seat; the side of the doorframe adjacent to the first sliding seat is provided with a second hinge seat, a lower end of the third connecting rod is hinged with the second hinge seat, and an upper end of the third connecting rod is hinged in the lower sliding slot and can slide along the lower sliding slot; the ends of the fourth connecting rod and the fifth connecting rod are hinged with each other at hinged points, the hinged points are jointly hinged in the lower sliding slot and can slide along the lower sliding slot, the other end of the fourth connecting rod is hinged with the first connecting rod, and the other end of the fifth connecting rod is hinged with the second connecting rod.

A sixth connecting rod is hinged between the hinged ends of the fourth connecting rod and the first connecting rod and the upper end of the third connecting rod.

The first connecting rod assembly comprises a first connecting plate hinged with the end of the piston rod of the hydraulic actuating cylinder, a second connecting plate hinged with the hinge shaft and a third connecting plate hinged between the first connecting plate and the second connecting plate, and the middle portion of the first connecting plate is hinged with a third hinge seat on the doorframe.

An upper edge and a side edge of the door leaf are fixed in the doorframe through a plurality of pressing mechanisms, a supporting arm is connected between a lower edge of the door leaf and the hinge shaft on the doorframe, the supporting arm is fixedly connected with the door leaf, and the supporting arm is connected with the hinge shaft.

The doorframe is shell-shaped, and comprises an antiskid plate on the front side and a back plate on the back side, the back plate has a curved structure, and the cross section of the back plate is spoon-shaped.

The present invention has the following technical effects:

The invention combines the guardrail assembly with the bow door, and the guardrail can be unfolded when the bow door is opened, ensuring the protective security of a passage which is formed after the bow door is connected to the dock; the invention is designed with a reasonable structure and has simple operations for unfolding the guardrail and opening the bow door; and the hydraulic actuating cylinder has a short stroke and good support stability when actuating the bow door.

Figure 1:
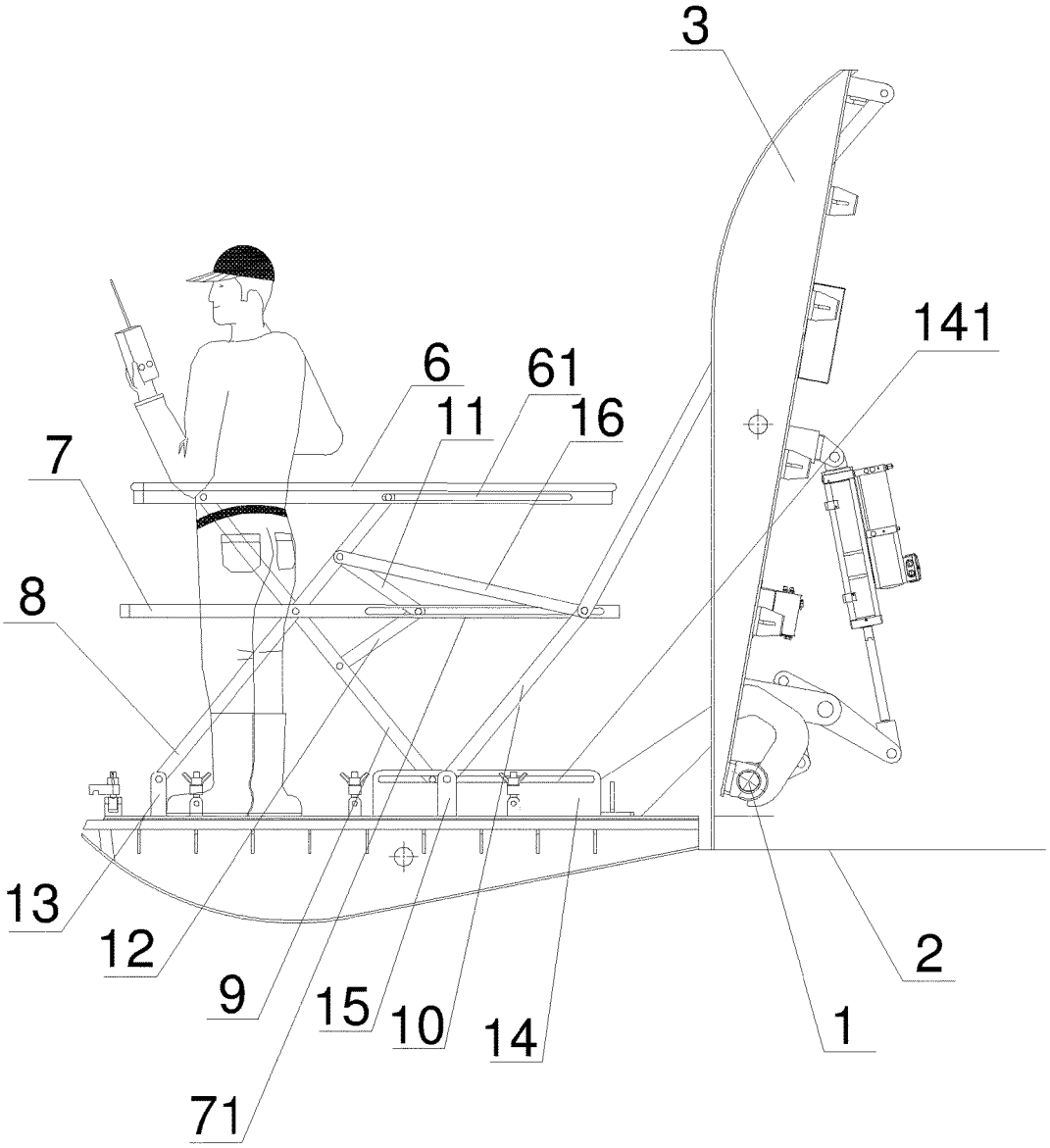
FIG. 1 is a structural schematic diagram of the invention.

In the drawings there are: 1, hinge shaft; 2, deck; 3, doorframe; 31, antiskid plate; 32, back plate; 4, door leaf; 5, hydraulic actuating cylinder; 6, upper guardrail; 61, upper sliding slot; 7, lower guardrail; 71, lower sliding slot; 8, first connecting rod; 9, second connecting rod; 10, third connecting plate; 11, fourth connecting plate; 12, fifth connecting plate; 13, first hinge seat; 14, first sliding seat; 141, sliding slot of sliding seat; 15, second hinge seat; 16, sixth connecting plate; 17, first connecting plate; 18, second connecting plate; 19, third connecting plate; 20, third hinge seat; 21, pressing mechanism; and 22, supporting arm.

DETAILED DESCRIPTION OF THE PREFERRED EMBODIMENT

The preferred embodiment of the invention will be further illustrated below in detail with drawings.

Figure 2:
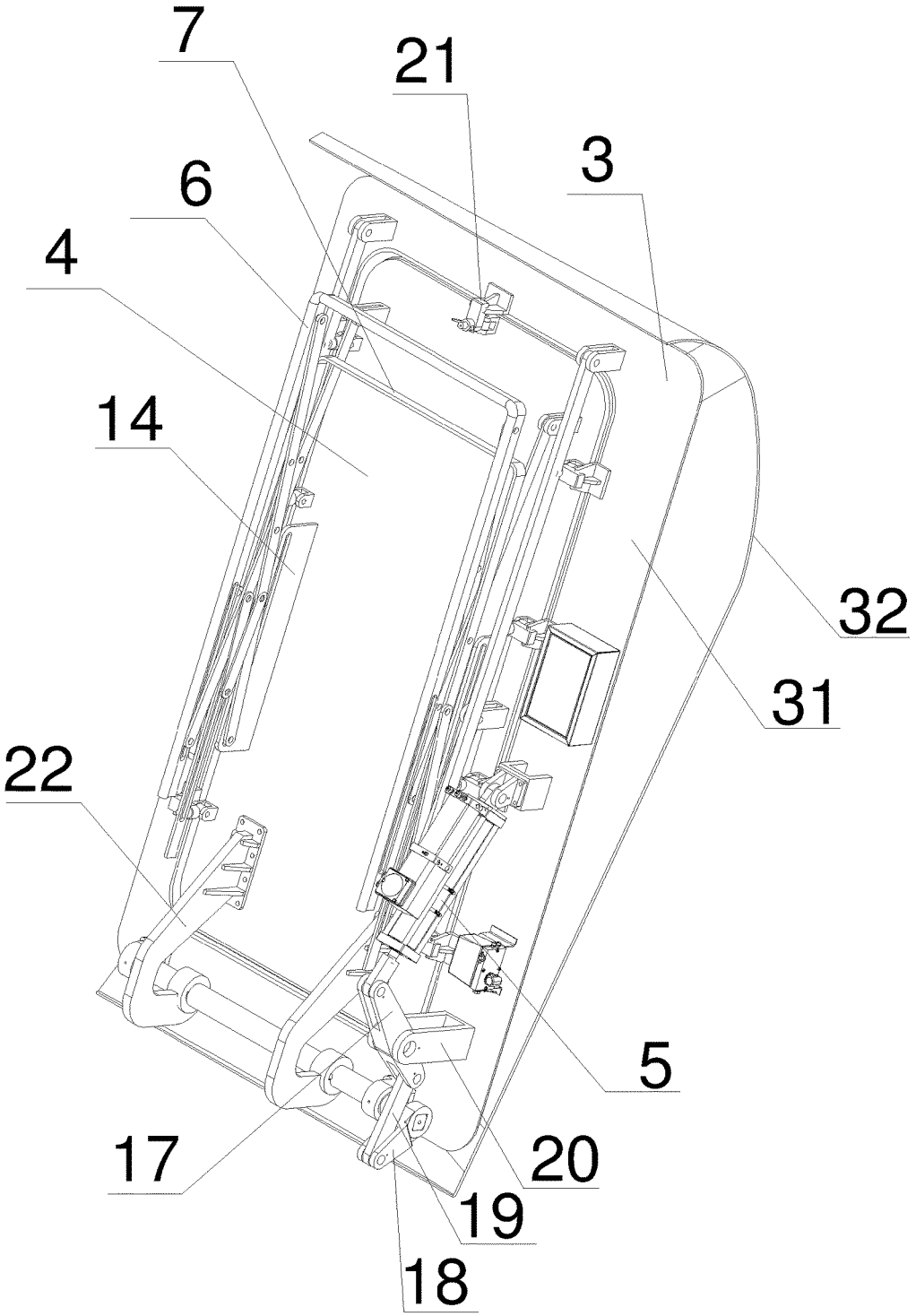
FIG. 2 is a stereo structural diagram of the invention.

As shown in FIGS. 1 and 2, the hydraulic bow door apparatus of this embodiment comprises a bow door movably mounted on a deck 2 by a hinge shaft 1, wherein, the bow door comprises a doorframe 3 and a door leaf 4 hermetically mounted together, the front side of the doorframe 3 is mounted with a hydraulic actuating cylinder 5, the cylinder body of the hydraulic actuating cylinder 5 is hinged with the doorframe 3, the end of its piston rod is hinged with the hinge shaft 1 through a first connecting rod assembly, after the piston rod of the hydraulic actuating cylinder 5 is pushed out, the bow door is turned into a horizontal placement state; and the front side of the bow door is mounted with a foldable guardrail assembly. As shown in FIG. 2, the first connecting rod assembly comprises a first connecting plate 17 hinged with the end of the piston rod of the hydraulic actuating cylinder 5, a second connecting plate 18 hinged with the hinge shaft 1 and a third connecting plate 19 hinged between the first connecting rod 17 and the second connecting plate 18, and the middle portion of the first connecting plate 17 is hinged with a third hinge seat 20 on the doorframe 3.

As shown in FIGS. 1 and 2, the guardrail assembly comprise an upper guardrail 6 and a lower guardrail 7 which are set up and down after being unfolded, the upper guardrail 6 and the lower guardrail 7 are U-shaped, and both sides of the upper guardrail 6 and the lower guardrail 7 are connected with the doorframe 3 through the second connecting rod assembly. The upper guardrail 6 is hinged with the doorframe 3 through a first connecting rod 8 and a second connecting rod 9 which are crosswise hinged, the hinged point between the first connecting rod 8 and the second connecting rod 9 is hinged with the lower guardrail 7, a third connecting rod 10 is connected between the lower guardrail 7 and the doorframe 3, and a fourth connecting rod 11 and a fifth connecting rod 12 are respectively connected between the lower guardrail 7 and the first connecting rod 8 and the second connecting rod 9.

As shown in FIG. 1, both sides of the doorframe 3 are symmetrically provided with a first hinge seat 13 and a first sliding seat 14, the hinge seat 13 and the first sliding seat 14 are located on both ends of the doorframe 3, and the first sliding seat 14 is provided with a sliding slot 141 of the sliding seat; the upper guardrail 6 is provided with an upper sliding slot 61, the lower guardrail 7 is provided with a lower sliding slot 71; the first hinge seat 13 is hinged with the lower end of the first connecting rod 8, and the upper end of the first connecting rod 8 is hinged in the upper sliding slot 61 and can slide along the upper sliding slot 61, and the lower end of the second connecting rod 9 is hinged in the sliding slot 141 of the sliding seat and can slide along the sliding slot 141 of the sliding seat; the side of the doorframe 3 adjacent to the first sliding seat 14 is provided with a second hinge seat 15, the lower end of the third connecting rod 10 is hinged with the second hinge seat 15, and the upper end of the third connecting rod 10 is hinged in the lower sliding slot 71 and can slide along the lower sliding slot 71; ends of the fourth connecting rod 11 and the fifth connecting rod 12 are hinged with each other, the hinged points are jointly hinged in the lower sliding slot 71 and can slide along the lower sliding slot 71, the other end of the fourth connecting rod 11 is hinged with the first connecting rod 8, and the other end of the fifth connecting rod 12 is hinged with the second connecting rod 9.

In order to improve the supporting stability of the upper guardrail 6, a sixth connecting rod is hinged between the hinged ends of the fourth connecting rod 11 and the first connecting rod 8 and the upper end of the third connecting rod 10.

The upper edge and the side edge of the door leaf 4 are fixed in the doorframe 3 through a plurality of pressing mechanisms 21, a supporting arm 22 is connected between the lower edge of the door leaf 4 and the hinge shaft 1 on the doorframe 3, the supporting arm 22 is fixedly connected with the door leaf 4, and the supporting arm 22 is connected with the hinge shaft 1.

In order to improve strength of the doorframe 3 and reduce its weight, as shown in FIGS. 1 and 2, the doorframe 3 is shell-shaped, and comprises an antiskid plate 31 on the front side and a back plate 32 on the back side, the back plate 32 has a curved structure, and the cross section of the back plate 32 is spoon-shaped.

The above embodiments are the preferred embodiments of the present invention, which are merely used to facilitate the description of the present invention, and are not intended to limit the present invention in any form. Equivalent embodiments with local changes or modifications made by those skilled in the field by using technical content revealed by the invention without departing from the scope and the content of technical features of the present invention shall still fall within the protection scope of the present invention.

The invention claimed is:

1. A hydraulic bow door apparatus, comprising a bow door movably mounted on a deck (2) by a hinge shaft (1), the bow door comprises a doorframe (3) and a door leaf (4) hermetically mounted together, the front side of the doorframe (3) is mounted with a hydraulic actuating cylinder (5), the cylinder body of the hydraulic actuating cylinder (5) is hinged with the doorframe (3), an end of a piston rod of the hydraulically driven cylinder (5) is hinged with the hinge shaft (1) through a first connecting rod assembly, after the piston rod is pushed out, the bow door is turned into a horizontal placement state; and the front side of the bow door is mounted with a foldable guardrail assembly;

wherein the guardrail assembly comprises an upper guardrail (6) and a lower guardrail (7) which are set up and down after being unfolded, the upper guardrail (6) and the lower guardrail (7) are hinged with the doorframe (3) through a second connecting rod assembly; the upper guardrail (6) is hinged with the doorframe (3) through a first connecting rod (8) and a second connecting rod (9) which are crosswise hinged, the hinged point between the first connecting rod (8) and the second connecting rod (9) is hinged with the lower guardrail (7), a third connecting rod (10) is connected between the lower guardrail (7) and the doorframe (3), and a fourth connecting rod (11) and a fifth connecting rod (12) are respectively connected between the lower guardrail (7) and the first connecting rod (8) and the second connecting rod (9).

2. The hydraulic bow door apparatus according to claim 1, wherein the upper guardrail (6) and the lower guardrail (7) are U-shaped, with both sides connected with the doorframe (3) through the second connecting rod assembly.

3. The hydraulic bow door apparatus according to claim 1, wherein both sides of the doorframe (3) are symmetrically provided with a first hinge seat (13) and a first sliding seat (14), the hinge seat (13) and the first sliding seat (14) are located on both ends of the doorframe (3), and the first sliding seat (14) is provided with a sliding slot (141) of the sliding seat; the upper guardrail (6) is provided with an upper sliding slot (61), the lower guardrail (7) is provided with a lower sliding slot (71); the first hinge seat (13) is hinged with a lower end of the first connecting rod (8), and an upper end of the first connecting rod (8) is hinged in the upper sliding slot (61) and can slide along the upper sliding slot (61), and a lower end of the second connecting rod (9) is hinged in the sliding slot (141) of the sliding seat and can slide along the sliding slot (141) of the sliding seat; the side of the doorframe (3) adjacent to the first sliding seat (14) is provided with a second hinge seat (15), a lower end of the third connecting rod (10) is hinged with the second hinge seat (15), and an upper end of the third connecting rod (10) is hinged in the lower sliding slot (71) and can slide along the lower sliding slot (71); the ends of the fourth connecting rod (11) and the fifth connecting rod (12) are hinged with each other at hinged points, the hinged points are jointly hinged in the lower sliding slot (71) and can slide along the lower sliding slot (71), the other end of the fourth connecting rod (11) is hinged with the first connecting rod (8), and the other end of the fifth connecting rod (12) is hinged with the second connecting rod (9).

4. The hydraulic bow door apparatus according to claim 3, wherein a sixth connecting rod (16) is hinged between the hinged ends of the fourth connecting rod (11) and the first connecting rod (8) and the upper end of the third connecting rod (10).

5. The hydraulic bow door apparatus according to claim 1, wherein the first connecting rod assembly comprises a first connecting plate (17) hinged with the end of the piston rod of the hydraulic actuating cylinder (5), a second connecting plate (18) hinged with the hinge shaft (1) and a third connecting plate (19) hinged between the first connecting plate (17) and the second connecting plate (18), and the middle portion of the first connecting plate (17) is hinged with a third hinge seat (20) on the doorframe (3).

6. The hydraulic bow door apparatus according to claim 1, wherein the doorframe (3) is provided with a plurality of pressing mechanisms (21), an upper edge and a side edge of the door leaf (4) are fixed in the doorframe (3) through the plurality of pressing mechanisms, a supporting arm (22) is connected between a lower edge of the door leaf (4) and the hinge shaft (1) on the doorframe (3), the supporting arm (22) is fixedly connected with the door leaf (4), and the supporting arm (22) is connected with the hinge shaft (1).

7. The hydraulic bow door apparatus according to claim 1, wherein the doorframe (3) is shell-shaped and comprises an antiskid plate (31) on the front side and a back plate (32) on the back side, the back plate (32) has a curved structure, and the cross section of the back plate (32) is spoon-shaped.

* * * * *